US009162239B2

(12) United States Patent
Renner

(10) Patent No.: US 9,162,239 B2
(45) Date of Patent: Oct. 20, 2015

(54) DEVICE FOR THE MECHANICAL INVERSION OF DIRECTION OF A ROTATING CONTROL COMPONENT OF A LANDSCAPE SPRINKLER DEVICE

(75) Inventor: Thomas Renner, Ulm (DE)

(73) Assignee: HUSQVARNA AB, Huskvarna (SE)

( * ) Notice: Subject to any disclaimer, the term of this patent is extended or adjusted under 35 U.S.C. 154(b) by 1142 days.

(21) Appl. No.: 12/997,529

(22) PCT Filed: Jun. 10, 2009

(86) PCT No.: PCT/EP2009/004154

§ 371 (c)(1),
(2), (4) Date: Mar. 4, 2011

(87) PCT Pub. No.: WO2009/152980

PCT Pub. Date: Dec. 23, 2009

(65) Prior Publication Data

US 2011/0226871 A1 Sep. 22, 2011

(30) Foreign Application Priority Data

Jun. 17, 2008 (DE) ..... 10 2008 030 022

(51) Int. Cl.
*B05B 3/16* (2006.01)
*B05B 3/04* (2006.01)
(Continued)

(52) U.S. Cl.
CPC ..... *B05B 3/0436* (2013.01); *B05B 3/044* (2013.01); *B05B 3/0431* (2013.01); *B05B 15/10* (2013.01)

(58) Field of Classification Search
CPC .... B05B 3/0431; B05B 3/0436; B05B 15/10; B05B 3/044
USPC ..... 239/242, 263.3, 255, 256, 263, 236, 239/237
See application file for complete search history.

(56) References Cited

U.S. PATENT DOCUMENTS 3,861,168 A * 1/1975 Sayers ..... 62/388
5,148,991 A * 9/1992 Kah, Jr. ..... 239/242
(Continued)

FOREIGN PATENT DOCUMENTS

DE 921179 C 12/1954
DE 2813515 A1 10/1978
(Continued)

OTHER PUBLICATIONS

Deutsches Patent—Und Markenamt—Recherchebericht 10 2008 030 022.5, Jun. 17, 2008, pp. 1-4.
(Continued)

*Primary Examiner* — Len Tran
*Assistant Examiner* — Alexander Valvis
(74) *Attorney, Agent, or Firm* — Novak Druce Connolly Bove + Quigg LLP

(57) ABSTRACT

Mechanical inversion of direction of a rotating control component of a landscape sprinkler device. Such a device, having a switching member with end stops associated therewith in both pivoting directions the control component, against said stops the switching member stops and is actuated, wherein at least one end stop can be adjusted coaxially with respect to a pivoting axis of the control component. The switching member is configured in an elastically resilient manner on the contact region thereof that is positioned at the height of the end stops such that the contact region retreats back from the adjusting path of the end stop in case of an overload, and devices are provided in order to re-establish the contact region at a defined position in the rotation angle region between the two end slops from the retreated position.

12 Claims, 4 Drawing Sheets

Figure 4:
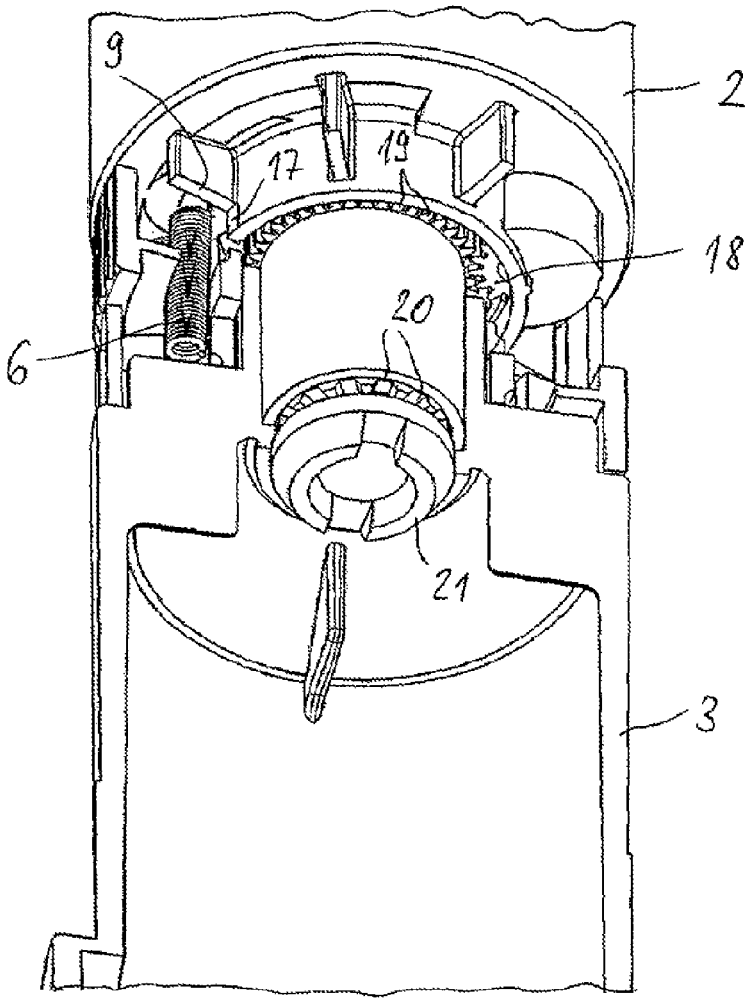

(51) Int. Cl.

| | |
|---|---|
| ***B05B 3/00*** | (2006.01) |
| ***B05B 15/00*** | (2006.01) |
| *B05B 15/10* | (2006.01) |

(56) References Cited

U.S. PATENT DOCUMENTS

| | | | | |
|---|---|---|---|---|
| 6,869,026 | B2 * | 3/2005 | McKenzie et al. | 239/237 |
| 7,086,609 | B2 * | 8/2006 | Wang | 239/263.3 |
| 7,445,164 | B2 * | 11/2008 | Liaw | 239/240 |
| 2003/0006306 | A1 * | 1/2003 | Clark | 239/242 |
| 2005/0082381 | A1 | 4/2005 | Wang | |
| 2007/0119978 | A1 | 5/2007 | Wang | |
| 2009/0014553 | A1 * | 1/2009 | Wang | 239/237 |

FOREIGN PATENT DOCUMENTS

| | | | |
|---|---|---|---|
| DE | 102006027313 | A1 | 12/2007 |
| DE | 10142141 | A1 | 2/2011 |
| DE | 202004009069 | U1 | 2/2011 |
| EP | 1864717 | A2 | 12/2007 |
| RU | 2208310 | C2 | 7/2003 |
| RU | 39497 | U1 | 8/2004 |
| SU | 1728356 | A1 | 4/1992 |
| WO | 2009152980 | A1 | 12/2009 |

OTHER PUBLICATIONS

International Search Report, PCT/EP2009/004154, Sep. 16, 2009.

German version of Mention of Grant issued by the Russian Patent Office; dated Jun. 10, 2009; 4 pages.

English Abstract of Russian Publication No. RU 2208310, published Jul. 20, 2003, downloaded Jun. 5, 2012, 1 page.

English Abstract of European Publication No. EP 1864717, published Dec. 12, 2007, downloaded Jun. 5, 2012, 2 pages.

Russian version of Mention of Grant issued by the Russian Patent Office; dated Jun. 10, 2009; 7 pages.

* cited by examiner

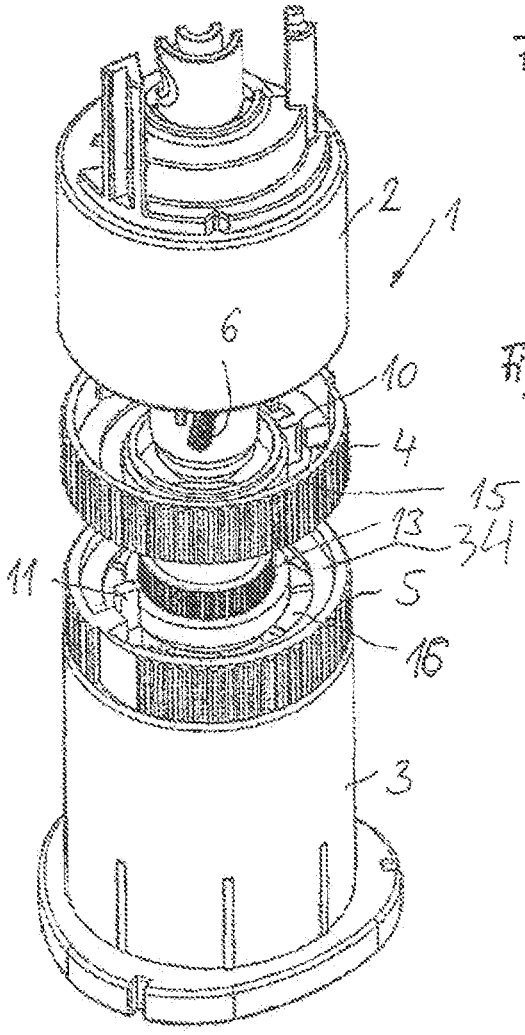
Fig. 1
Fig. 2a
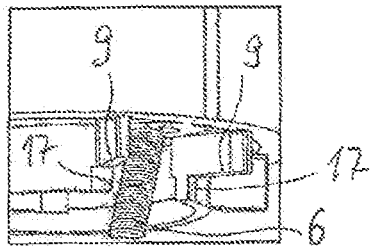
Fig. 2b
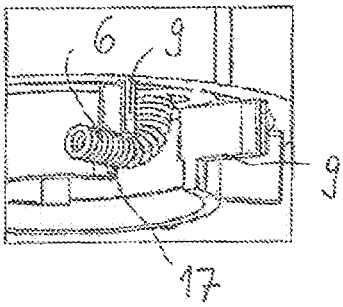
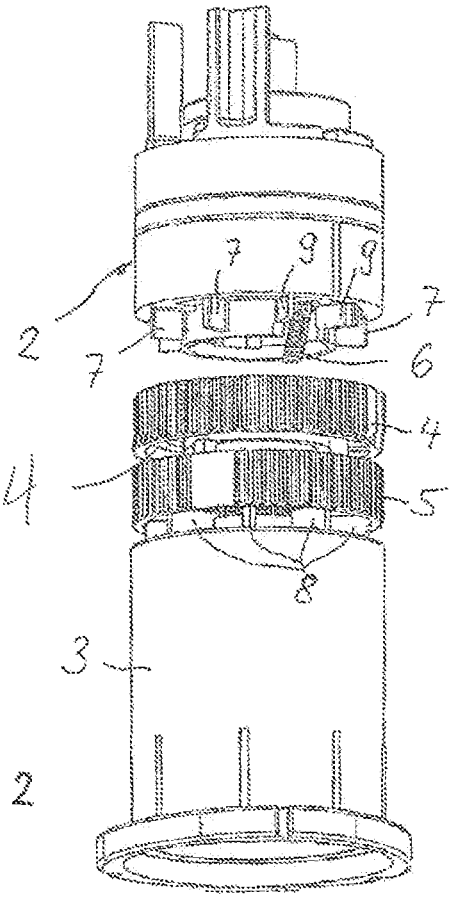
Fig. 2

Fig. 3a
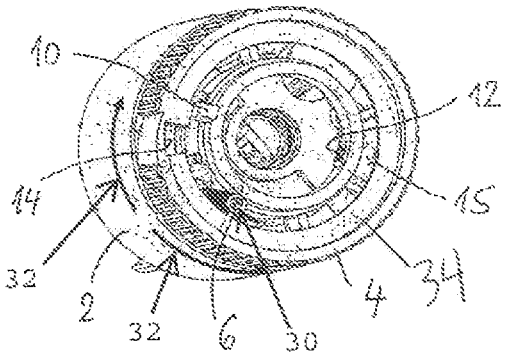
Fig. 3b
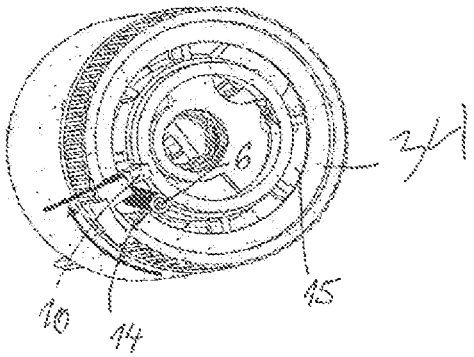
Fig. 3c
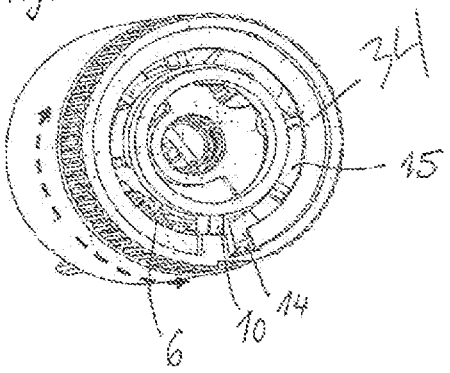
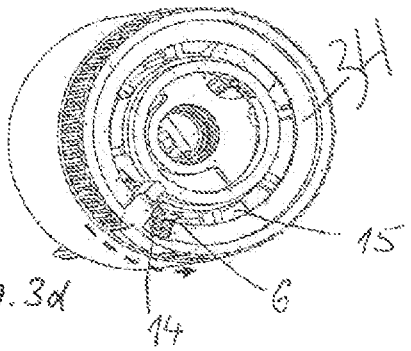
Fig. 3d

DEVICE FOR THE MECHANICAL INVERSION OF DIRECTION OF A ROTATING CONTROL COMPONENT OF A LANDSCAPE SPRINKLER DEVICE

The invention relates to a device for the mechanical reversal of direction of a rotatable control component of a landscape watering device with a switching member with which are associated, in the two directions of rotation of the control component, end stops at which the switching member stops and is actuated, where at least one end stop can be adjusted coaxially with respect to an axis of rotation of the control component, as well as a landscape watering device of this type. A device of this type is known from EP 186 4717 A2. It is problematic in devices of this type that improper operations can lead to damage of parts of the device. In addition to this, improper adjustments of the end stops can lead to controlled watering operation no longer being possible.

It is the object of the invention to provide a device which is of the type stated in the introduction and combines security against vandalism with high functional reliability.

This object is realized by the fact that, in its contact area positioned at the level of the end stops, the switching member is implemented elastically in such a manner that in case of an overload the contact area withdraws from the adjustment path of the end stop and that means are provided to once again lift up the contact area from the withdrawn position at a defined position in the rotation angle range between the two end stops. With the realization according to the invention damage to parts of the device and in particular damage to the switching member is prevented. In addition to this, malfunctions are prevented since the means for the lifting up are implemented in such a manner that the contact area always emerges between the two end stops which cause the reversal of direction of the switching member. The realization according to the invention is suitable for rectangular rain guns whose control components have an approximately horizontal axis of rotation as well as for rain guns or sprinklers with a vertically aligned axis of rotation such as in particular so-called pop-up sprinklers.

In an embodiment of the invention the contact area of the switching member is implemented to be elastically resilient as a function of force. Thus the contact area only withdraws elastically resiliently beginning at a defined load limit In this way additional functions can be assigned to the contact area. Preferably the elastic withdrawal is accomplished by bending. Through the force-dependent bending it is possible to define a type of loading at which certain functions occur.

The contact area is preferably implemented as an elastically bendable spring element. In the unloaded position the spring element is stable in form and preferably implemented to be linear. On an overshoot of the corresponding load limit the spring element bends elastically. The necessary force or load at which the spring element bends is reached with the invention first by a correspondingly shaped bent lug at the adjacent functional part of the device and second by the physical characteristics of the spring element, where in particular its spring constant and its shape are determinative.

In an additional embodiment of the invention a load limit of the contact area, specifically a load limit at which the contact area yields elastically, is greater than a load required for switching the switching member. In this way it is ensured that the contact area is formed so rigidly or stably in form that it fulfills the function of switching the switching member in a functionally reliable manner.

In an additional embodiment of the invention a load limit of the contact area, specifically a load limit at which it yields elastically, is greater than a load limit at which an overload safety device between the rotatable control component and a stationary housing part yields. Preferably the device according to the invention comprises an overload coupling which provides for decoupling a transmission for turning the control component when there is an overload. An overload safety device of this type prevents destruction of the transmission in case of improper operation or in case of unforeseen blocking of the control component. Through the described development it is possible during turning of the at least one end stop to entrain in that turning the housing part in which the switching member, and accordingly also the transmission, are housed.

In an additional embodiment of the invention the switching member comprises a tiltable switching pin which is provided with the elastically resilient contact area. The switching pin projects preferably from the device's housing part which includes the transmission. Preferably the elastically resilient contact area is provided at a free end area of the switching pin. The switching pin is, in an advantageous manner, implemented as a rocking lever acting on a switching rocker, where the rocking lever is rigidly connected to the switching rocker. A tilting of the rocking lever thus necessarily leads to a switching of the switching rocker functioning as a switch valve.

In an additional embodiment of the invention the switching pin is disposed eccentrically to an axis of rotation of the control component and the contact area projects axially into at least one stationary functional part which flanks the contact area both radially inwards and radially outwards. In this way it is ensured that the contact area cannot deflect, either inwards or outwards.

In a particularly advantageous manner the functional part comprises an annular groove into which the contact area projects and which flanks the contact area both radially inwards and radially outwards.

In an additional embodiment of the invention an end stop is associated with the stationary functional part. The at least one stationary functional part is understood to mean a functional part which in the watering operation of the device remains stationary with respect to the rotatable control component. However, it is possible to adjust the functional part in order to adjust the at least one end stop. In addition to its adjustment capability the stationary functional part is provided with an arresting mechanism, preferably in the form of a detent, which ensures stationary positioning in the watering operation of the device.

In an additional embodiment of the invention the stationary functional part is formed as an adjusting ring which can be adjusted with respect to the housing part and can be arrested in various adjustment positions. The adjusting ring can be turned coaxially with respect to the axis of rotation of the control component.

In an additional embodiment of the invention there is provided, adjacent to the first adjusting ring and as an additional functional part, an additional adjusting ring which can be adjusted with respect to the housing part and can be arrested in various adjustment positions.

In an additional embodiment of the invention the contact area projects axially into both adjusting rings and the additional adjusting ring is provided with the second end stop. The two adjusting rings thus comprise the two end stops for the contact area in order to be able to effect the switching of the switching member. Preferably both adjusting rings are provided with annular groove sections so that in the watering operation of the device the movement of the contact area between the end stops is in annular grooves which are in the adjusting rings and are coaxially adjacent to one another.

In an additional embodiment of the invention both adjusting rings are implemented with identical construction and are mounted in installation positions which are reversed with respect to one another. In this way it is possible to make both adjusting rings of plastic in the same tool mold. The production costs can be kept low in this way.

In an additional embodiment of the invention the control component provides in the vicinity of the contact area a bent lug as well as a deflection area in which the contact area is positioned in its elastically bent deflection position. The bent lug and the deflection area make possible a defined bending of the contact area, in particular of the spring element and a defined positioning of the spring element in the bent deflection position so long as the spring element still has not reached the area at which it can lift up once again.

In an additional embodiment of the invention the means for lifting up the contact area comprise at least one radial recess in the radial flanking area of the at least one functional part, where that radial recess is dimensioned so that the contact area in its elastically bent deflection position can, at the level of the recess, due to its elastic restoring force lift up into its unloaded starting position. The recess is preferably provided adjacent to an end stop of the functional part on the end stop's side at which the contact area stops at the end stop in normal watering operation.

In an additional embodiment of the invention the contact area is formed by a helical spring. Preferably the helical spring is provided with a close spiral and is coordinated in its dimensioning with a diameter of the switching pin in such a manner that the helical spring can be plugged by its end area onto a tip of the switching pin in a force-locking manner.

Additional advantages and features of the invention follow from the claims and from the following description of a preferred embodiment example of the invention, said embodiment example being presented the aid of the figures.

Figure 6:
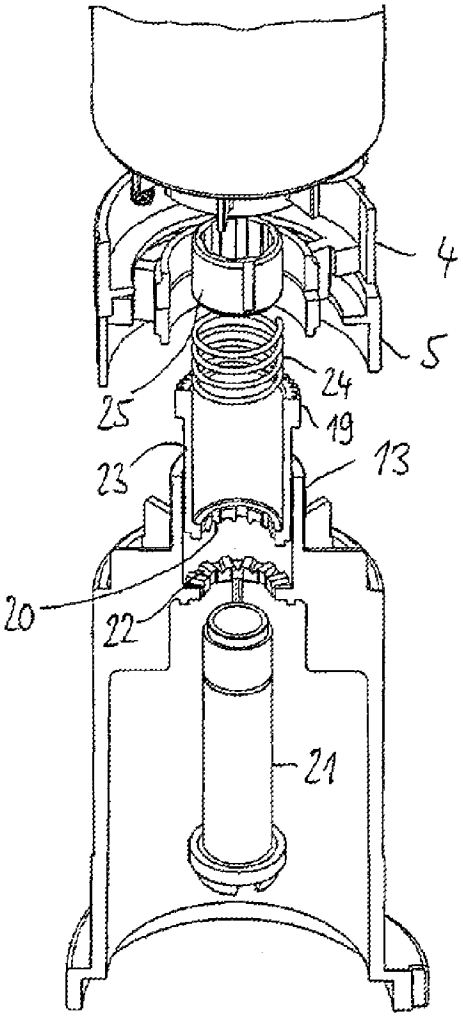
Figure 5:
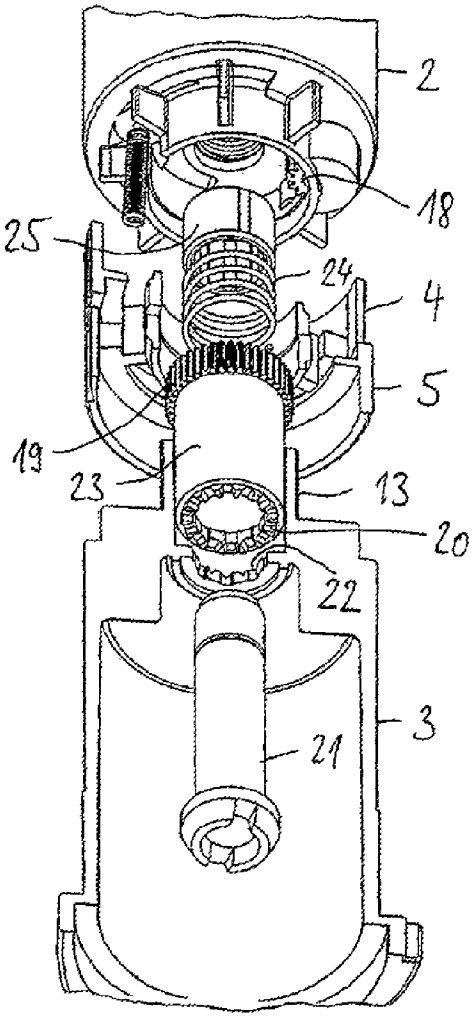

FIG. 1 shows in an exploded representation a form of embodiment of a landscape watering device with a mechanism according to the invention and for the mechanical reversal of direction of a rotatable control component, FIG. 2 shows another exploded representation of the device according to FIG. 1 but from a different perspective, FIGS. 2*a* and 2*b* show an enlarged detailed view of the device in two different operating positions, FIGS. 3*a* to 3*d* show, in different operating positions, a part of the device according to FIGS. 1 and 2, FIG. 4 shows a partially cut-open representation of the device according to FIGS. 1 and 2 in enlarged perspective representation, FIG. 5 shows a perspective, cut-open exploded representation of the device according to FIGS. 1 and 2, and FIG. 6 shows the device according to FIG. 5 from a different perspective.

A landscape watering device according to FIGS. 1 to 6 is implemented as a rain gun in a functional position with approximately vertical axis of rotation. The landscape watering device 1 represents a so-called pop-up rain gun. The rain gun comprises a rain gun head 2 which is formed as a rotatable control component in the sense of the invention. The rain gun comprises in addition to this a stationary housing part 3 which is provided in the operating mode with a stand for secure positioning on the ground underneath. The rain gun head 2 forms a housing part which comprises on its upper side a water outlet nozzle as well as a transmission known in principle. The transmission is a speed reduction transmission which reduces the rotational motion of a rapid turbine wheel, through which there is a corresponding water flow, to a correspondingly slower rotational motion of the control component, that is, the rain gun head 2. A water jet flows through the turbine wheel approximately radially in a manner known in principle, said water jet being conducted through one of two nozzle outlets at a distance from one another. In alternation one of the two nozzle outlets is always closed by the switching member so that the water jet strikes the turbine wheel through one or the other nozzle outlet in alternation. The nozzle outlets are disposed at a distance from one another in such a manner that the rotational direction of the turbine wheel changes depending on which nozzle outlet is open. The transmission comprises on its output side away from the turbine wheel a planetary pinion 18 (FIGS. 4 and 5) which meshes with a stationary circumferential toothing 19 of the housing part 3. Through the meshing of the planetary pinion 18 and the rotatable positioning of the rain gun head 2 with respect to the stationary housing part 3 the rain gun head 2 is turned in operation of the landscape watering device by the water pressure always present and the water jet striking the turbine wheel.

In order to effect a reversal of direction of the turbine wheel and consequently of the rain gun head 2 the switching member, which is not represented in more detail, is implemented as a switching rocker, and always closes one of the two nozzle outlets, is provided with a switching pin which projects downwards approximately parallel to the axis of rotation of the rain gun head 2 and towards the housing part 3. The switching pin is provided at its tip with an elastically resilient contact area in the form of a spring element 6 which is represented in the figures. In the embodiment example represented the spring element 6 is formed as a closely wound helical spring which is plugged onto a tip of the switching pin in a force-locking and thus positionally secured manner and/or in a form-locking or material locking manner to the tip of the contact pin. In the unloaded rest position of the spring element 6 it is extended linearly as an extension of the switching pin. In its normal functional position the spring element 6 is set obliquely, analogously to the switching pin, since the switching rocker is always held in an open position of one of the two nozzle outlets by a spring loading mechanism not represented in more detail.

In order to switch the switching pin and consequently the spring element 6, that is, to tilt it into the other switching position, two stationary functional parts in the form of adjusting rings 4, 5 are associated with the spring element 6 in the area of the housing part 3. Both adjusting rings 4, 5 are implemented in plastic and identically to one another and mounted in installation positions reversed with respect to one another and with respect to the rain gun head 2 or to the housing part 3. Both adjusting rings 4, 5 are provided on the outer side with a ribbing in order to enable simple manual adjustment by an operator. Both adjusting rings 4, 5 comprise an inner ring, each with a toothing section 12. During mounting the two toothing sections 12 are plugged onto an annular projecting profiling 13 together with the corresponding inner rings. The projecting profiling 13 is a single-piece part of the housing part 3, as can be seen with the aid of FIGS. 1, 5, and 6. The engagement acting between the toothing sections 12 and the projecting profiling 13 is implemented so that manual turning of the adjusting rings 4, 5 in the circumferential direction is enabled. However, at the same time the engagement is also so stable that the two adjusting rings 4, 5 remain in the stationary functional positions during rotation of the rain gun head 2 and a stopping of the switching pin and thus the spring element 6 at the subsequently described end stops.

Each adjusting ring 4, 5 comprises coaxial to its inner ring a respective annular groove 15, 16 which is bounded radially outwards by an annular flange 34 which projects on the radial inner side from an outer ring forming the ribbing. The annular groove 15, 16 has a width so large that the spring element 6 of the switching member can project though both annular grooves 15, 16 with little radial play when the rain gun is fully mounted. Thus during rotation of the rain gun head 2 the spring element 6 can migrate in the annular space formed by the annular groove 15, 16.

In order to limit the rotational movement of the rain gun head 2 and to cause a reversal of the direction of rotation, each of the adjusting rings 4, 5 comprises a respective end stop 10, 11 which projects axially into the annular groove and thus into the annular space. One defines as a function of the position of the adjusting rings 4, 5 with respect to one another the length of the circular arc over which the spring element 6 can sweep during a rotational movement of the rain gun head 2 within the annular groove 15, 16 before it stops at the respective end stop.

The stability of form of the spring element 6 is designed so that the spring element 6 during a stop at one of the two end stops 10, 11 remains in its unbent, elongated starting position and is only tilted to the other side, whereby the switching rocker of the switch element is pivoted and the other nozzle outlet is closed. Thus the desired reversal of direction for the rain gun head 2 necessarily results and consequently the device's landscape watering resulting over a defined pivot range.

In order to prevent a malicious manual turning of the rain gun 2 beyond this pivot range defined by the annular groove from leading to damage of the switching member, the end of the switching pin, namely the contact area formed by the spring element 6 and coming into contact with the end stops, is implemented to be elastically resilient. For this purpose bent lugs 9 are provided on the housing of the rain gun head 2 on both sides of the spring element 6, said bent lugs being implemented as radially outwardly projecting flanges. These flanges correspond to guide flanges 7 which are distributed over the circumferential face of the rain gun head 2, project radially outwards from an inner ring, and serve to support and guide the adjusting ring 4. On the housing part 3 corresponding guiding and supporting flanges 8 are provided which serve to support and guide the lower adjusting ring 5. The flanges forming the bent lugs 9 have a smaller axial height than the flanges 7. Along with this the flanges forming the bent lugs 9 are implemented lower by approximately a distance which corresponds to the diameter of the spring element 6. During a bending of the spring element 6 over the corresponding bent lug 9 a deflection area is thus formed into which the bent part of the spring element 6 can project without being axially in the way of the adjacent adjusting ring 4. Obviously neither of the two end stops 10, 11 can project axially into this deflection area. The end stops 10, 12 [sic, 11] end with their corresponding annular sections necessarily at the facing boundary edges of the flanges 7 so that turning of the rain gun head 2 with respect to the adjusting ring 4 is not prevented. As soon as the spring element 6 is thus bent out according to FIG. 2*b*, the rain gun head 2 can also be turned beyond the corresponding end stop 10, 11 of the respective adjusting ring 4, 5. The spring element 6 remains in its bent position in the deflection area below the bent lug 9. The spring element 6 cannot deflect upwards since it is bound by the inwardly projecting annular flange of the adjusting ring 4. In addition to this, in each of the two tilt positions a supporting edge 17 prevents the spring element 6 from deflecting radially inwards in the bent position. Thus the spring element 6 remains in a defined bent position while the rain gun head 2 is turned out over the corresponding end stop 10. The corresponding operating positions can be seen clearly with the aid of FIGS. 3*a* to 3*d*. In FIG. 3*a* the spring element 6 and also the switching member 30 are in a normal operating position. By the appropriate turning along path 32 of the rain gun head 2 the spring element 6 is brought near to the end stop 10 and strikes it according to FIG. 3*b*. In so doing, the switching member is necessarily switched over so that the direction of rotation of the turbine wheel would change. Then if the rain gun head 2 is manually turned further (FIG. 3*c*) in the previous direction (FIG. 3*b*), the spring element 6 bends. As soon as the manual load is taken away, the rain gun head 2 turns back into the direction of the end stop 10 due to the switching process previously executed. In order to enable lifting up of the spring element 6 as soon as the spring element 6 has once again reached its normal operational pivot area, there is provided adjacent to the end stop 10 a recess 14 which is aligned radially outwards and thereby interrupts the annular flange 34 lying radially outwards. This recess 14 is dimensioned to be so large that the spring element 6 can lift axially upwards through this recess 14. Since the rain gun head 2 moves further in this direction due to the previously executed switch-over process, the spring element 6 necessarily arrives in the annular groove 15 after the lifting up. Thus the spring element 6 is once again located in the previously described annular space and in its predefined pivot range so that the normal turning of the rain gun head 2 and the correspondingly set reversal of direction can once again be taken in accordance with the defined pivot range. The recess 14 is provided on a side of the end stop 10, specifically the side facing the other, corresponding end stop of the other adjusting ring. In this way it is ensured that, regardless in which direction it is bent, the spring element 6 always emerges once again in the annular groove in the pivot range which corresponds to the pivot range in normal operation.

The form of embodiment according to FIGS. 1 to 6 ensures in addition that with proper turning of the adjusting rings 4, 5 for setting a new pivot angle of the rain gun the rain gun head 2 is entrained in the turning. In order to avoid bending out of the spring element 6, the rigidity of the spring element 6 is dimensioned to be so large that a subsequently described overload coupling between the rain gun head 2 and the housing part 3 is released before the spring element 6 is deflected by bending. The overload coupling between the rain gun head 2 and the housing part 3 can be seen with the aid of FIGS. 4 to 6 and is already known in principle in itself. The overload coupling comprises an axially movable guide sleeve 23 on which the toothing 19 is formed with which the planetary pinion 18 of the rain gun head 2 meshes. The coupling sleeve 23 is mounted so that it can move axially and rotatably in the housing part 3. The coupling sleeve 23 comprises on its apical edge lying away from the toothing 19 an apical toothing 20 which engages in a corresponding catch mechanism 22 on an annular flange of the housing part 3. In addition to this, in the mounted state the coupling sleeve 23 lies coaxially over a journal 21 which projects out upwards via the coupling sleeve 23. In an area of the journal 21, specifically the area projecting out upwards via the coupling sleeve 23, a spiral coiled spring 24 is pushed coaxially onto the journal 21, said spiral coiled spring being secured axially to the journal 21 by a securing ring 25. The spiral coiled spring 24 is supported axially on the upper apical edge of the coupling sleeve 23 in the area of the toothing 19. The coupling sleeve 23 is thus pressed downwards by the spiral coiled spring 24 so that the apical toothing 20 is pressed against the catch mechanism 22 and the coupling sleeve 23 is thus positioned. The journal 21 is supported axially on a side of the annular flange of the housing part 3, specifically the side facing away from the catch mechanism 22. The apical toothing 20 and the corresponding catch mechanism 22 are provided with tooth chamfer corresponding in such a manner that for higher torque the coupling sleeve 23 is turned against the compressive force of the spiral coiled spring 24. Thereby the apical toothing 20 and the catch mechanism 22, i.e. their teeth corresponding to one another, go out of engagement, whereby also the transmission coupling between the housing part 3 and the rain gun head 2 is disengaged.

The rigidity of the spring element 6 is so great that with proper adjustment of the adjusting rings 4, 5 the previously described overload coupling disengages as soon as one of the end stops 10, 11 strikes the spring element 6 so that the rain gun head 2 is turned together with the adjustment of the corresponding adjusting ring 4, 5. The load limit at which the spring element 6 bends is thus higher than the load limit beginning at which the previously described overload coupling go out of engagement. The coordination of the load limits can be accomplished in a simple manner by coordination of the shape of the spiral coiled spring 24 on the one hand and the shape and the choice of material of the spring element 6 on the other hand.

The invention claimed is:

1. A device for the mechanical reversal of direction of a rotatable control component of a landscape watering device comprising:

a stationary housing comprising:

two adjustment rings, wherein each of the two adjustment rings has an annular flange and an end stop at the same horizontal level, wherein each of the annular flanges has one recess near a corresponding one of the end stops, wherein at least one of the two end stops can be adjusted coaxially with respect to an axis of rotation of the adjustment rings, wherein the annular flange and the corresponding end stop form an adjustment path; and the rotatable control component comprising:

an elastic switching member, wherein the switching member includes:

a switching pin having a stationary area mounted on the rotatable control component and a contact area, the contact area positioned at the same horizontal level as the corresponding end stop and the annular flange of the adjustment rings, thereby the contact area of the switching pin is placed within the adjustment path; and wherein, in case of an overload, one of the two end stops pushes the corresponding contact area of the switching pin to withdraw from the adjustment path through a corresponding recess in the annular flange in a line direction tangent to the adjustment path configured to mechanically reverse the direction of the rotatable control component.

2. The device according to claim 1, wherein the contact area is implemented to be elastically resilient as a function of force.

3. The device according to claim 2, wherein the contact area has a load limit in which the contact area yields elastically, the load limit is greater than a load required for switching the switching member.

4. The device according to claim 2, wherein the contact area has a load limit in which the contact area yields elastically, the load limit is greater than a load limit at which an overload safety device between the rotatable control component and a stationary housing part yields.

5. The device according to claim 1, wherein both adjusting rings are implemented with identical construction and are mounted in installation positions which are reversed with respect to one another.

6. The device according to claim 1, wherein the rotatable control component provides in the vicinity of the contact area and on both sides a bent lug as well as a deflection area in which the contact area is positioned in its elastically bent deflection position.

7. The device according to claim 1, wherein the contact area is formed by a spring element.

8. A landscape watering device with a rotatable control component and a stationary housing according to claim 1.

9. The device according to claim 1, wherein the switching member comprises a tillable switching pin which is provided with the elastically resilient contact area.

10. The device according to claim 9, wherein the switching pin is disposed eccentrically with respect to an axis of rotation of the control component and that the contact area projects axially into at least one stationary functional part which flanks the contact area both radially inwards and radially outwards.

11. The device according to claim 10, wherein an end stop is associated with the at least one stationary functional part and the at least one stationary functional part is formed as an adjusting ring which can be adjusted with respect to the housing part and can be arrested in various adjustment positions.

12. The device according to claim 11, wherein adjacent to the first adjusting ring and as an additional functional part, an additional adjusting ring which can be adjusted with respect to the housing part and can be arrested in various adjustment positions.

* * * * *